US012337255B1

(12) United States Patent
Welsh-Brockman

(10) Patent No.: US 12,337,255 B1
(45) Date of Patent: Jun. 24, 2025

(54) DOLL SHOE WITH IMPROVED RETENTION

(71) Applicant: Amy Lynn Welsh-Brockman, Apex, NC (US)

(72) Inventor: Amy Lynn Welsh-Brockman, Apex, NC (US)

( * ) Notice: Subject to any disclaimer, the term of this patent is extended or adjusted under 35 U.S.C. 154(b) by 0 days.

(21) Appl. No.: 18/817,833

(22) Filed: Aug. 28, 2024

(51) Int. Cl.
*A63H 3/52* (2022.01)

(52) U.S. Cl.
CPC ..... *A63H 3/52* (2013.01)

(58) Field of Classification Search
CPC ..... A63H 3/00–52
See application file for complete search history.

(56) References Cited

U.S. PATENT DOCUMENTS 831,330 A * 9/1906 Doebrich ..... A63H 3/04 623/53
1,002,363 A * 9/1911 Bell ..... A63H 3/02 446/370
1,148,540 A * 8/1915 Sancier ..... A63H 3/12 446/376
1,317,060 A * 9/1919 Wittkowski ..... A63H 3/04 446/374
1,456,422 A * 5/1923 Cabana ..... A63H 3/46 446/381
2,043,658 A * 6/1936 Graitcer ..... A63H 3/36 446/390
2,407,367 A * 9/1946 Geller ..... A63H 3/46 446/376
2,649,806 A * 8/1953 Monaghan ..... A63H 3/46 446/381
2,663,970 A * 12/1953 Brodrib ..... A63H 7/02 446/317
2,760,303 A * 8/1956 Del Mas ..... A63H 3/16 40/418
2,838,873 A * 6/1958 Taylor ..... A63H 3/46 403/116
2,994,157 A * 8/1961 Beebe ..... A63H 3/46 403/107
3,395,484 A * 8/1968 Smith ..... A63H 3/04 446/374
4,622,021 A * 11/1986 Darrigo, Sr. ..... A63H 3/48 446/320

(Continued)

FOREIGN PATENT DOCUMENTS

CA 3133288 A1 * 8/2022 ..... A43B 3/28
CN 209934058 U * 1/2020 ..... A63H 3/16

(Continued)

*Primary Examiner* — Jacob J Cigna
(74) *Attorney, Agent, or Firm* — Ashley D. Johnson; Dogwood Patent and Trademark Law

(57) ABSTRACT

The invention is a doll shoe that can be used and reliably retained on a wide variety of doll feet. The doll shoe includes a conical or tapered top opening configured to receive and cover at least a toe or foot portion of a doll foot. The opening includes a plurality of retention elements that function to grip and retain the doll foot within the opening. Advantageously, the retention element retain any of a variety of doll feet (e.g., peg feet) of various sizes and shapes. The shoe further includes a counterweight that functions to offset the weight of the doll and allows the doll to stand upright.

17 Claims, 13 Drawing Sheets

(56) References Cited

U.S. PATENT DOCUMENTS

| | | | | | |
|---|---|---|---|---|---|
| 5,176,560 | A * | 1/1993 | Wetherell | A63H 11/18 | 446/175 |
| 5,205,775 | A * | 4/1993 | Brodrib | A63H 3/46 | 446/317 |
| 5,254,029 | A * | 10/1993 | Myland | A63J 19/006 | 446/376 |
| 5,516,314 | A * | 5/1996 | Anderson | A63H 3/36 | 446/268 |
| 5,622,293 | A * | 4/1997 | LeFevre | A44C 5/003 | 63/23 |
| 6,129,606 | A * | 10/2000 | Yuen | A63H 15/04 | 446/351 |
| 11,738,280 | B2 * | 8/2023 | Clark | A63H 3/44 | 446/374 |
| 11,931,665 | B2 * | 3/2024 | Osculati | A63H 3/44 | |
| 11,986,748 | B2 * | 5/2024 | Welsh-Brockman | A63H 3/52 | |
| 2003/0073376 | A1 * | 4/2003 | Lee | A63H 3/14 | 446/268 |
| 2018/0126288 | A1 * | 5/2018 | Vincent | A63H 37/00 | |
| 2022/0249967 | A1 * | 8/2022 | Welsh-Brockman | A63H 3/50 | |
| 2023/0390656 | A1 * | 12/2023 | Hsu | A63H 3/02 | |
| 2023/0405483 | A1 * | 12/2023 | Hsu | A63H 3/04 | |

FOREIGN PATENT DOCUMENTS

| | | | | | |
|---|---|---|---|---|---|
| DE | 19721762 | A1 * | 1/1999 | A63H 3/16 | |
| ES | 2289936 | A1 * | 2/2008 | A63H 3/02 | |
| FR | 2534822 | A1 * | 10/1982 | | |
| GB | 383834 | A * | 3/1932 | | |
| GB | 388951 | A * | 4/1932 | | |
| GB | 1102509 | A * | 1/1967 | | |
| GB | 2108398 | A * | 5/1983 | A63H 3/46 | |
| JP | 2004121498 | A * | 4/2004 | A63H 3/16 | |

* cited by examiner

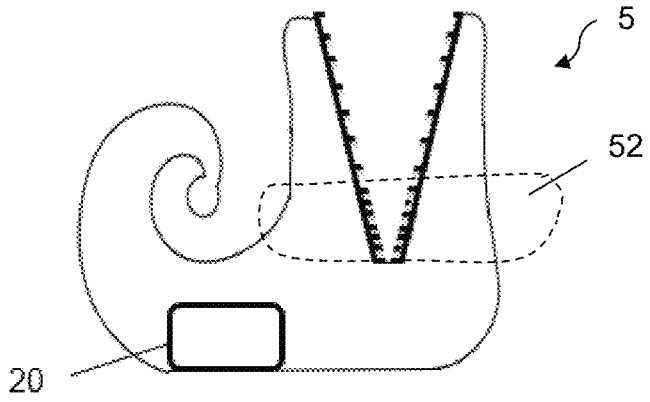
Fig. 6c
Fig. 7a
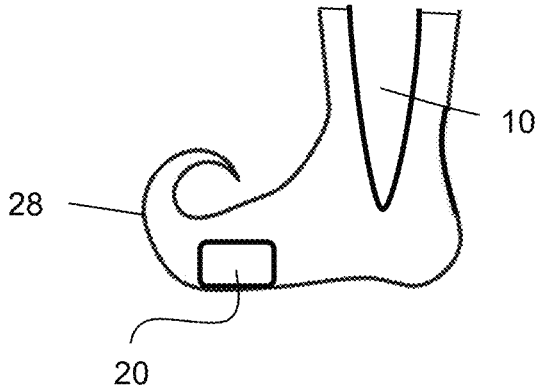
Fig. 7b
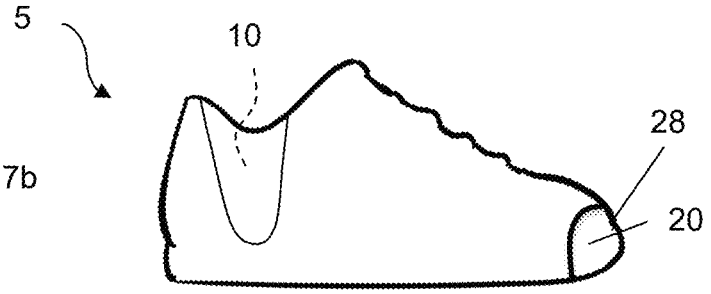

Fig. 7c
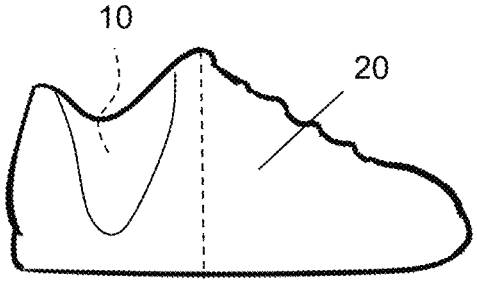
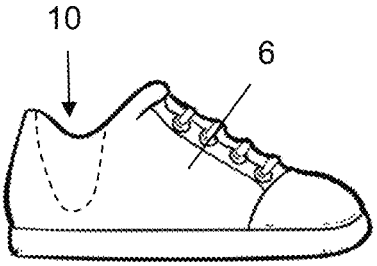
Fig. 8a
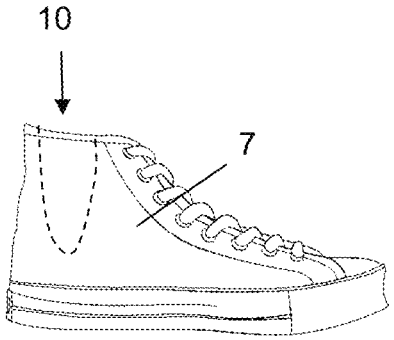
Fig. 8b
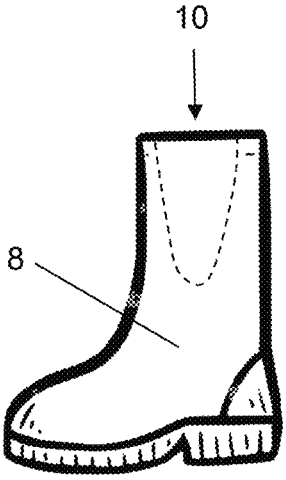
Fig. 8c
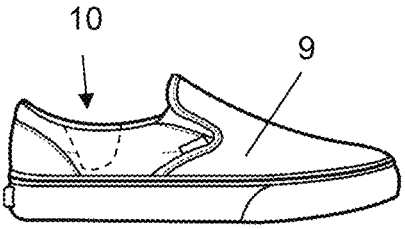
Fig. 8d

DOLL SHOE WITH IMPROVED RETENTION

FIELD OF THE INVENTION

The presently disclosed subject matter relates to a doll shoe that can be easily used and effectively retained on the feet of a wide variety of dolls. The presently disclosed subject matter also includes methods of making and using the doll shoes.

BACKGROUND OF THE INVENTION

Dolls have been used and enjoyed by children and collectors for centuries. Toy dolls come in a wide variety of shapes, sizes, and appearances to conform to the real life animal or human figure they are intended to represent. From the simple rag doll made of cloth material filled with stuffing to the finely detailed and highly realistic human baby dolls made from ceramic, wooden, or soft molded plastics materials, children in every culture enjoy playing with dolls. Toy dolls encourage children to use their imaginations and to develop human relationships. Thus, children use their imagination when playing with dolls in a variety of scenarios, such as singing on stage, driving in a car, or working in an office. During play, children routinely change the doll's clothing and footwear to match a particular scenario or play situation. However, when it comes to footwear, it is not uncommon for one or more shoes to become dislodged from the doll's foot and lost during play. It would therefore be beneficial to provide an improved doll shoe that is both aesthetically pleasing and that can be effectively retained on a doll's foot for an extended period of time.

SUMMARY OF THE INVENTION

In some embodiments, the presently disclosed subject matter is directed to a doll shoe comprising a top face and an opposed bottom face, a front face and an opposed rear face, and a pair of side faces. The top face comprises an opening that extends into an interior of the doll shoe, the opening defined by one or more retention elements. The shoe includes a counterweight.

In some embodiments, the opening has a conical shape.

In some embodiments, the opening has a first end adjacent to the top face of the doll shoe and an opposed second end within the shoe interior, and wherein the opening is tapered from the opening first end to the opening second end.

In some embodiments, the one or more retention elements are configured as a helical thread that tapers and extends a length of the opening.

In some embodiments, a diameter of the first end of the opening is about 0.2-2 inches and a diameter of the second end of the opening is about 0.1-1.9 inches.

In some embodiments, the one or more retention elements are configured as concentric rings, each ring having a diameter that decreases as the rings move from the opening first end to the opening second end.

In some embodiments, the diameter of a ring positioned adjacent to the first end of the opening is about 0.2-2 inches and the diameter of a ring positioned adjacent to the second end of the opening is about 0.1-1.9 inches.

In some embodiments, the concentric rings are uniformly distributed along the opening from the first end to the second end. For example, each successive ring is spaced a set distance (e.g., the same distance for all rings) from adjacent rings.

In some embodiments, the concentric rings are clustered adjacent to the first end of the opening, the second end of the opening, or between the first and second ends of the opening.

In some embodiments, the one or more retention elements are constructed from rubber, silicone, metal, wood, plastic, or combinations thereof.

In some embodiments, the one or more retention elements are rigid.

In some embodiments, the one or more retention elements are flexible.

In some embodiments, the counterweight is positioned adjacent to the front side of the shoe.

In some embodiments, the counterweight is configured as a region of the shoe positioned adjacent to, but separate from, the top opening of the shoe.

In some embodiments, the counterweight has a weight of about 1-16 ounces.

In some embodiments, the presently disclosed subject matter is directed to a method of retaining a doll shoe on a foot of a doll. Particularly, the method comprises inserting the doll foot within the top opening of the disclosed doll shoe. The method includes applying pressure such that the one or more retention elements contact and retain the doll foot within the top opening of the doll shoe. The method includes removing the pressure, whereby the one or more retention elements grip the doll foot and thereby retain the doll foot within the top opening of the shoe.

In some embodiments, the doll foot is a peg foot.

In some embodiments, a shoe is positioned on each foot of the doll.

In some embodiments, the doll maintains a standing position after the shoes have been retained on the feet of the doll. Stated another way, the doll can remain in a standing position with no additional support from the user or any implements (e.g., the doll does not lean and is not supported by the user's hand).

BRIEF DESCRIPTION OF THE DRAWINGS

FIGS. 6*a*-6*c* are cross-sectional views of doll shoes comprising clustered arrangements of retention elements within a shoe top opening in accordance with some embodiments of the presently disclosed subject matter.

FIGS. 7*a* and 7*b* are cross-sectional views of a doll shoe comprising a counterweight in accordance with some embodiments of the presently disclosed subject matter.

FIG. 7*c* is a cross-sectional view of a doll shoe comprising a counterweight region in accordance with some embodiments of the presently disclosed subject matter.

FIGS. 8*a*-8*e* are side plan views of doll shoes in accordance with some embodiments of the presently disclosed subject matter.

DETAILED DESCRIPTION OF THE INVENTION

Figure 1A:
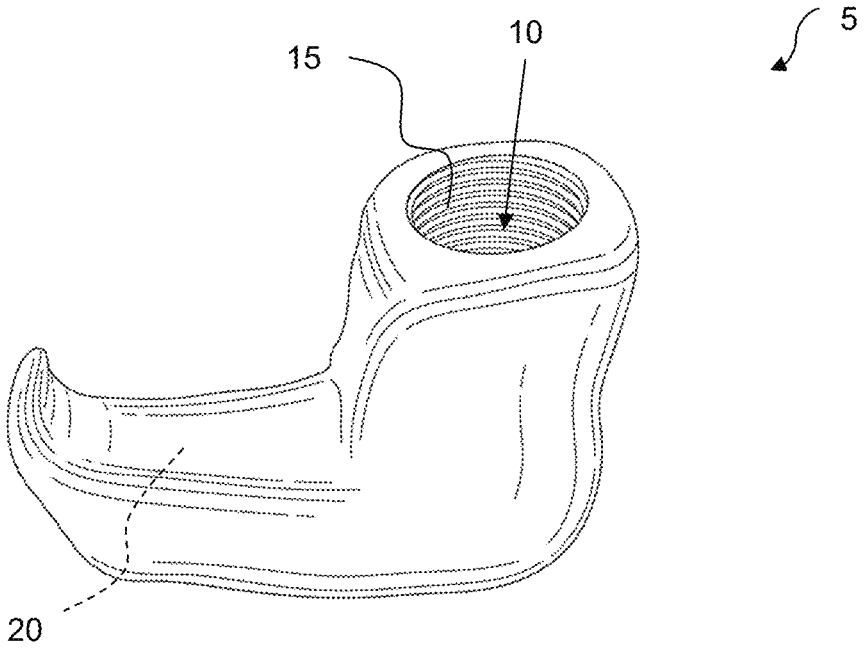
FIG. 1*a* is a perspective view of a doll shoe in accordance with some embodiments of the presently disclosed subject matter.

For the purpose of promoting an understanding of the principles of the present disclosure, reference will now be made to preferred embodiments and specific language will be used to describe the same. It will nevertheless be understood that no limitation of the scope of the disclosure is thereby intended, such alteration and further modifications of the disclosure as illustrated herein, being contemplated as would normally occur to one skilled in the art to which the disclosure relates.

Articles "a" and "an" are used herein to refer to one or to more than one (i.e., at least one) of the grammatical object of the article. By way of example, "an element" means at least one element and can include more than one element. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about." Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods. Thus, the term "about" is used to provide flexibility to a numerical range endpoint by providing that a given value may be "slightly above" or "slightly below" the endpoint without affecting the desired result.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

All methods described herein can be performed in any suitable order unless otherwise indicated herein or otherwise clearly contradicted by context. The use of any and all examples, or exemplary language (e.g., "such as") provided herein, is intended merely to better illuminate the invention, and does not pose a limitation on the scope of the invention unless otherwise claimed. No language in the specification should be construed as indicating any unclaimed element as essential to the practice of the invention.

Unless otherwise defined, all technical terms used herein have the same meaning as commonly understood by one of ordinary skill in the art to which this disclosure belongs.

Figure 1B:
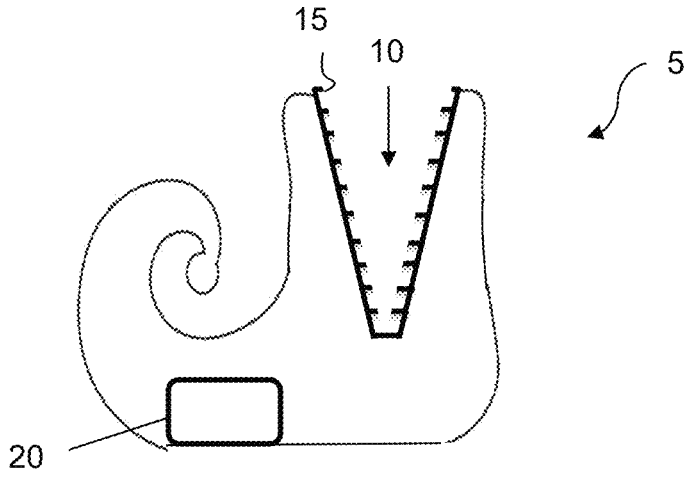
FIG. 1*b* is a cross-sectional side view of a doll shoe in accordance with some embodiments of the presently disclosed subject matter.
Figure 1C:
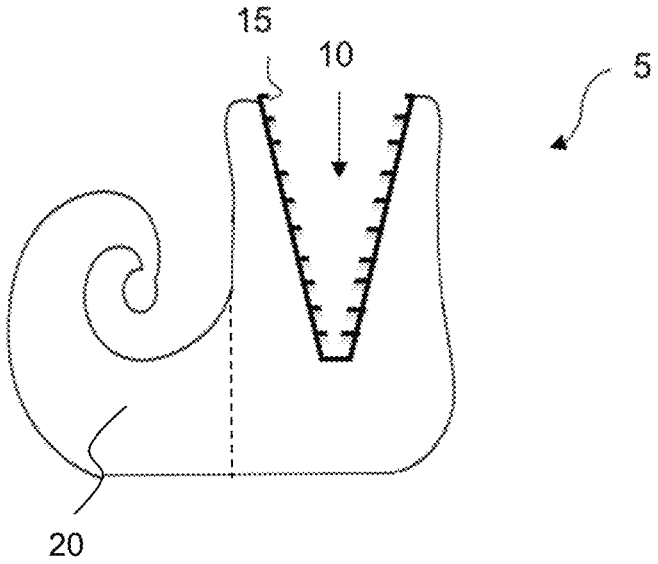
FIG. 1*c* is a cross-sectional side view of a doll shoe in accordance with some embodiments of the presently disclosed subject matter.

The presently disclosed subject matter is directed to a doll shoe that can be used and reliably retained on a wide variety of doll feet. Specifically, the term "doll shoe" refers to any type of footwear that can be used with any type of doll. The term "shoe" thus includes elf shoes, tennis shoes, running shoes, casual shoes, boots, wedges, high heeled shoes, and the like. The term "doll" refers to any type of toy or model, typically formed of human, humanoid, or animal character (although any shape can be used), often used as a toy for children or collectors. As shown in FIGS. 1*a* and 1*b*, doll shoe 5 includes top opening 10 sized and shaped to allow for the insertion of a doll leg and/or foot. The top opening is therefore configured to receive and retain at least a toe region or foot portion of a doll. The opening includes a plurality of retention elements 15 that function to grip and retain the doll foot within opening 10. Advantageously, the retention elements retain any of a variety of doll feet (e.g., peg feet) of various sizes and shapes. The shoe further includes counterweight 20 positioned at the toe end of the shoe that functions to offset the weight of the doll and allows the doll to stand upright, in some embodiments. In other embodiments, the counterweight can be configured as an area of increased density or weight compared to the remainder of the shoe, as shown in FIG. 1*c* (e.g., the portion of the shoe to the left of the dotted line, including the toe region, is constructed from a higher density material or a material that has increased weight compared to the area of the shoe to the right of the dotted line, including opening 10).

Figure 2A:
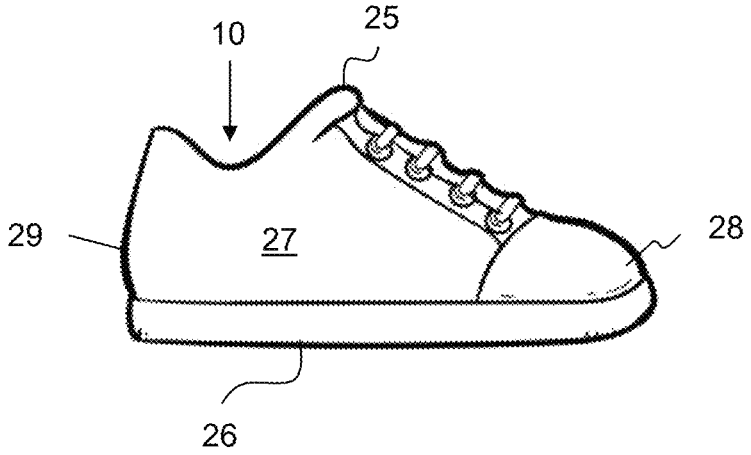
FIG. 2*a* is a side plan view of a doll shoe in accordance with some embodiments of the presently disclosed subject matter.
Figure 2B:
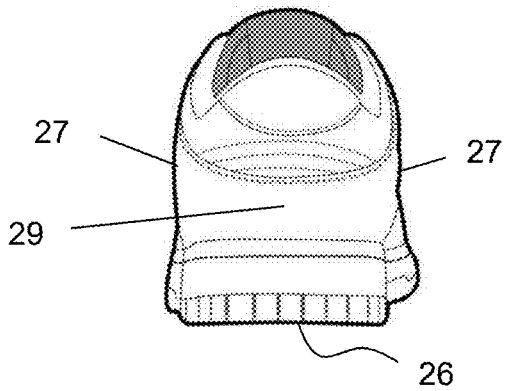
FIG. 2*b* is a rear view of a doll shoe in accordance with some embodiments of the presently disclosed subject matter.

FIG. 2*a* illustrates one embodiment of shoe 5 comprising top face 25 defined by top opening 10 and opposed bottom face 26 that rests upon a surface (such as the floor). The bottom surface of shoe 5 can be about horizontal in some embodiments, allowing a doll wearing shoe 5 to securely stand on a level surface. The shoe also includes a pair of side faces 27 that are positioned on the left and right sides of the shoe, as shown in FIG. 2*b*. As illustrated, the shoe also includes front face 28 (adjacent to a toe region) and rear face 29 (at the heel region of the shoe).

As noted above, top face 25 includes opening 10 configured in a tapered or conical shape that extends into interior 130 of the shoe. The remainder of the shoe is solid (e.g. is not hollow). The term "tapered" refers to a width that decreases along at least one direction (e.g., as the opening extends into the shoe interior). The term "conical" refers to having the shape of a cone. Opening 10 can thus have any cross-sectional shape, such as oval or round when the opening is configured to be conical in shape. However, the presently disclosed subject matter is not limited and the shape of the opening can be in a square, rectangular, triangular, octagonal, etc. configuration so long as it tapers from a first end (e.g., on the top face of the shoe) to a second end (within the interior of the shoe).

Figure 3A:
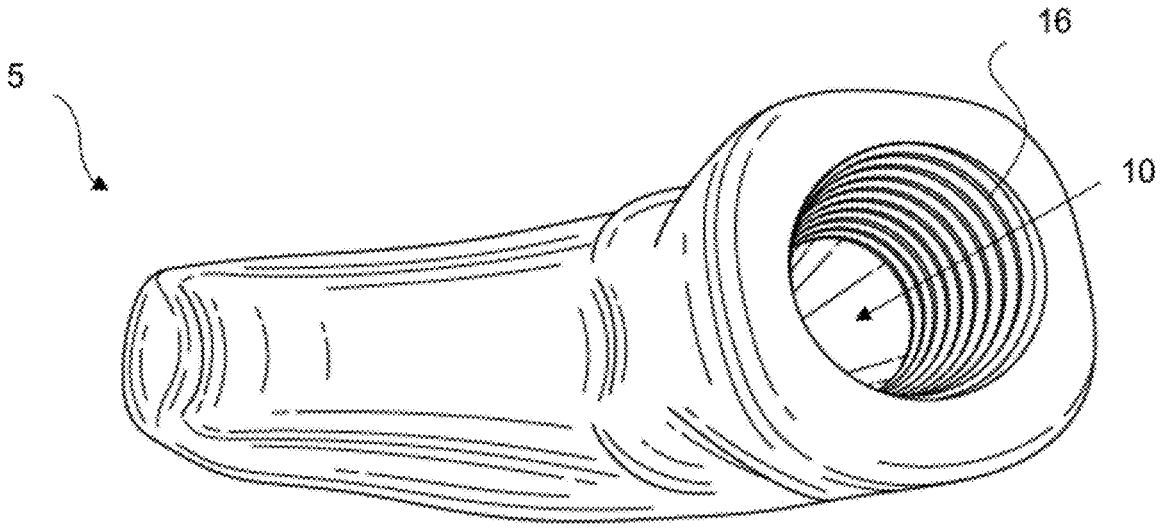
FIG. 3*a* is a top plan view of a doll shoe comprising screw thread retention elements in accordance with some embodiments of the presently disclosed subject matter.
Figure 3B:
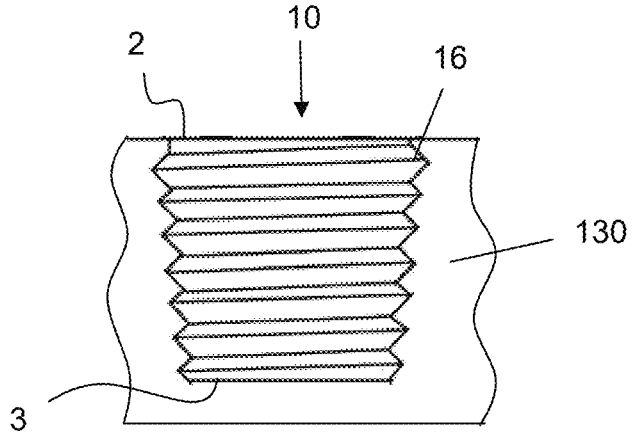
FIG. 3*b* is a cross-sectional view of a doll shoe top opening in accordance with some embodiments of the presently disclosed subject matter.
Figure 3C:
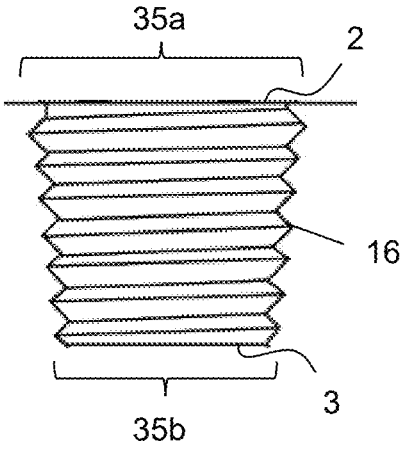
FIG. 3*c* is a cross-sectional view of a doll shoe top opening in accordance with some embodiments of the presently disclosed subject matter.
Figure 3D:
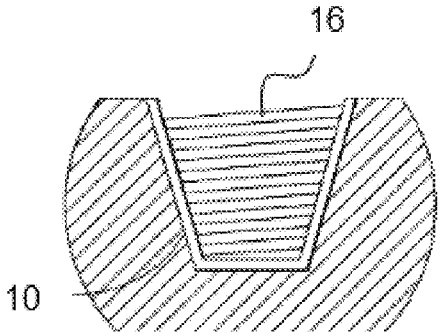
FIG. 3*d* is a cross-sectional view of a doll shoe top opening in accordance with some embodiments of the presently disclosed subject matter.

As noted above, the tapered or conical top opening includes a plurality of retention elements that extend the full length or a portion of the length of the opening within the interior of the shoe, as shown in FIG. 3*a*. FIG. 3*b* illustrates one embodiment of a retention element configured as helical thread 16 that tapers and extends the length of the opening (e.g., from opening first end 2 to second end 3 within the interior of the shoe). A helical thread therefore runs as a helical band, arranged on the interior of the top opening and extending down the length of the top opening within the shoe interior. The helical thread includes a conical shape with a diameter that decreases as the thread extends away from first end 2. As shown in FIG. 3*c* and FIG. 3*d*, first diameter 35*a* at opening first end 2 is greater than a second diameter 35*b* as the helical band extends down into the interior of the shoe. The helical thread therefore tapers from wider to narrower along the length of the top opening, from top end 2 to bottom end 3.

Figure 4A:
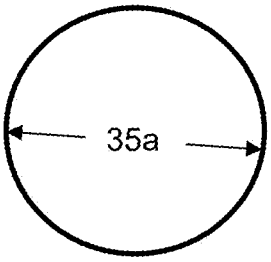
FIGS. 4*a* and 4*b* are cross-sectional views of doll shoe openings in accordance with some embodiments of the presently disclosed subject matter.
Figure 4B:
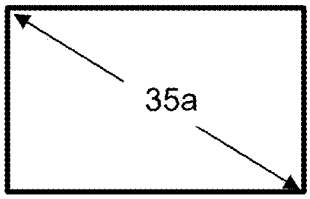
Figure 5A:
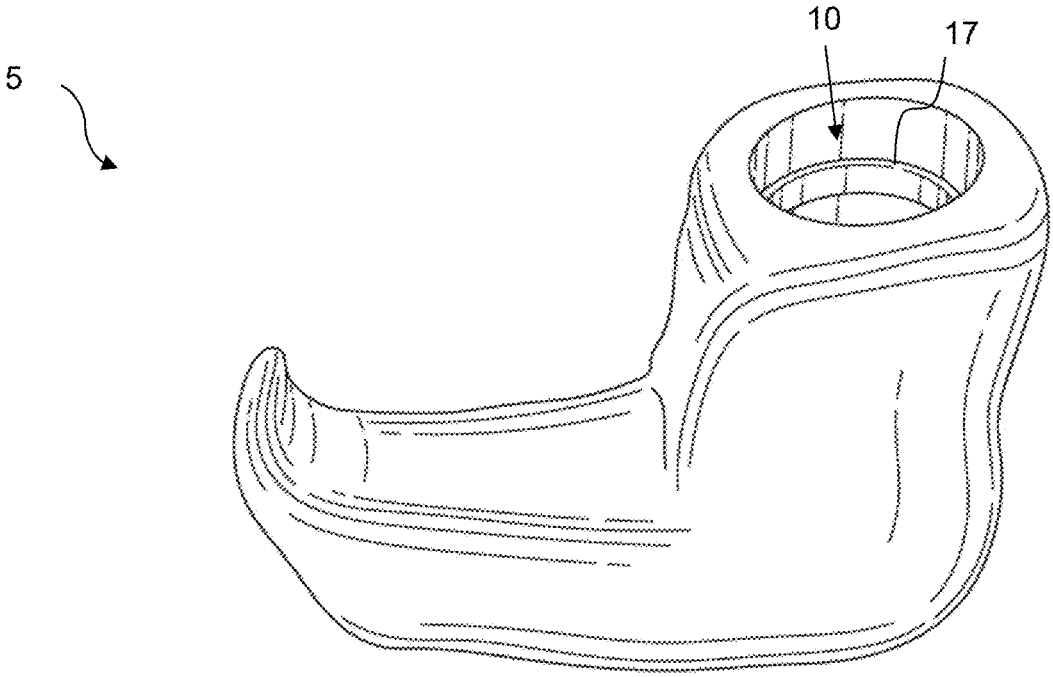
FIG. 5*a* is a perspective view of a doll shoe comprising ring retention elements in accordance with some embodiments of the presently disclosed subject matter.
Figure 5B:
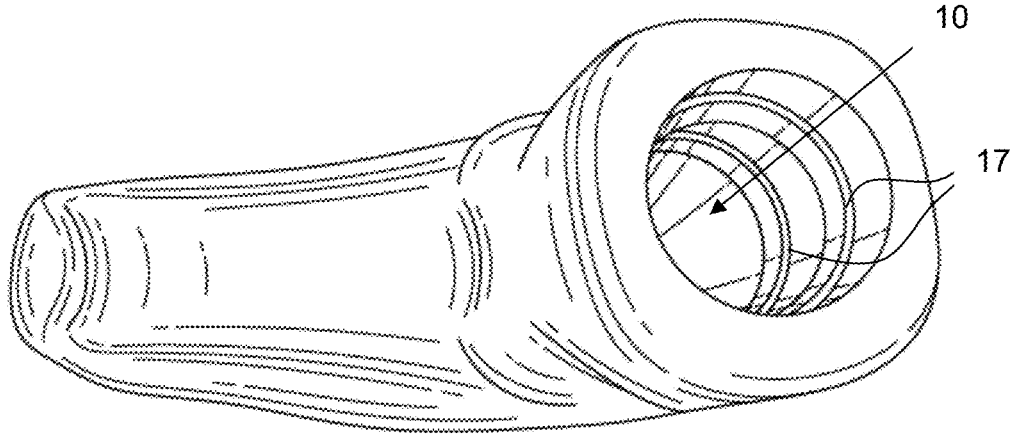
FIG. 5*b* is a top view of the doll shoe of FIG. 5*a* in accordance with some embodiments of the presently disclosed subject matter
Figure 5C:
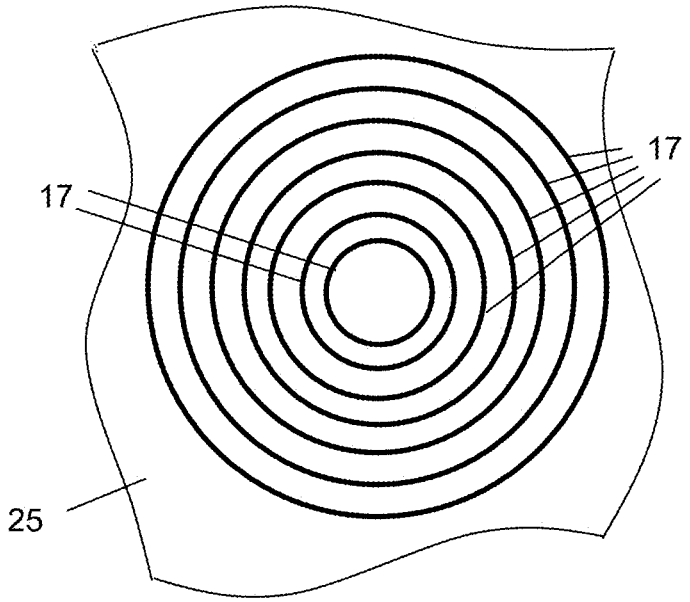
FIG. 5*c* is a top plan fragmentary view of a doll shoe comprising ring retention elements in accordance with some embodiments of the presently disclosed subject matter.
Figure 5D:
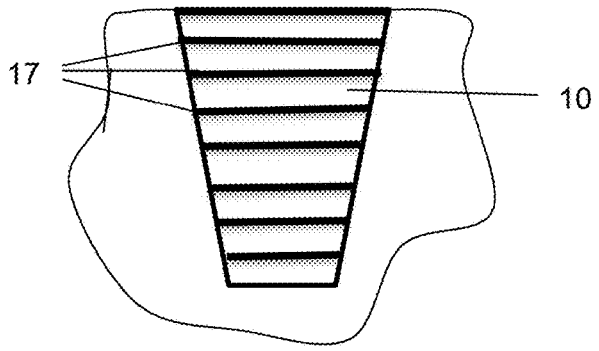
FIG. 5*d* is a cross-sectional view of a doll shoe comprising concentric ring retention elements in accordance with some embodiments of the presently disclosed subject matter.

In some embodiments, the first diameter can be about 5-50% larger than second diameter 35*b* (e.g., at least/no more than about 5, 10, 15, 20, 20, 25, 30, 35, 40, 45, or 50%). However, the presently disclosed subject matter is not limited and the shoe can include embodiments where the first diameter is at least/no more than about 50, 60, 70, 80, 90, or 100% more than the second diameter. The term "diameter" refers to the length of the longest straight line segment that passes through the center of a cross-sectional segment and whose endpoints lie on the segment. Two examples of cross-sectional shapes of the first end of opening 10 illustrating first diameter 35*a* are shown in FIGS. 4*a* and 4*b*.

In some embodiments, the diameter of the top opening at first end 2 can be about 0.2-2 inches (e.g., at least/no more than about 0.2, 0.25, 0.5, 0.75, 1, 1.25, 1.5, 1.75, or 2 inches). The diameter of the second end of the opening can be about 0.1-1.9 inches (e.g., at least/no more than about 0.1, 0.25, 0.5, 0.75, 1, 1.25, 1.5, 1.75, 1.8, or 1.9 inches). However, the presently disclosed subject matter is not limited and the range of the opening diameter can be configured greater or less than the noted ranges.

In some embodiments, the retention element can be configured as a series of concentric ribs 17 positioned along the outer surface of the top opening, as shown in FIGS. 5*a*-5*d*. The term "rib" refers to an outwardly directed protrusion extending from a surface. As shown, ribs 17 can span the entire or a portion of the length of the top opening (from first end 2 to second end 3), with the rings decreasing in diameter as the opening extends into the interior of the shoe. Thus, a top ring (adjacent to the top surface of the shoe at first end 2) can have the largest diameter compared to the remainder of the rings, while the bottom ring (adjacent to second end 3) can have the smallest diameter. Each successive ring gets progressively smaller as the rings travel from the opening first end to the opening second end.

In some embodiments, the top ring diameter can be about 5-50% larger than the bottom ring diameter (e.g., at least/no more than about 5, 10, 15, 20, 20, 25, 30, 35, 40, 45, or 50% larger). However, the presently disclosed subject matter is not limited and the shoe can include embodiments where the top ring diameter is at least/no more than about 50, 60, 70, 80, 90, or 100% larger than the bottom ring diameter.

In some embodiments, the diameter of the top ring can be about 0.2-2 inches (e.g., at least/no more than about 0.2, 0.25, 0.5, 0.75, 1, 1.25, 1.5, 1.75, or 2 inches). The diameter of the bottom ring can be about 0.1-1.9 inches (e.g., at least/no more than about 0.1, 0.25, 0.5, 0.75, 1, 1.25, 1.5, 1.75, 1.8, or 1.9 inches). However, the presently disclosed subject matter is not limited and the range of the ring diameters can be configured greater or less than the noted ranges.

As described in detail below the retention elements (rings 17 and/or helical threads 16) can be configured to engage a doll foot, which can have any suitable shape (e.g., a peg foot). As a result, the shoe provides for increased retention of the doll foot compared to other doll shoes.

Figure 6A:
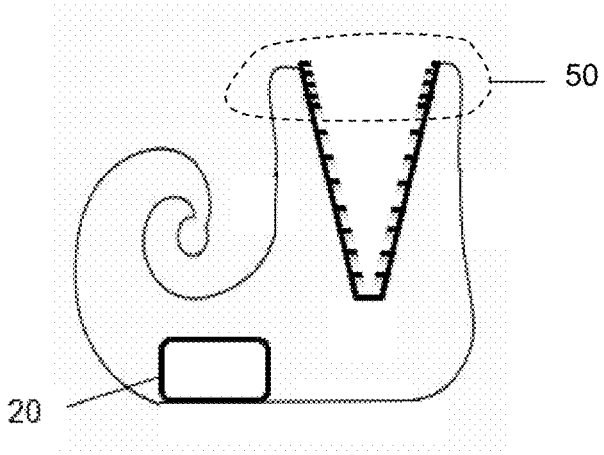
Figure 6B:
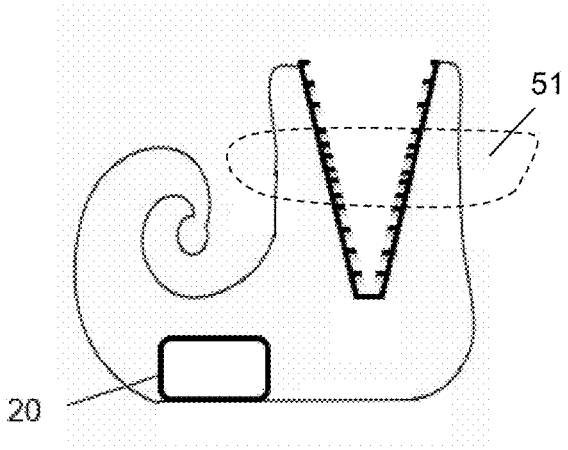
Figure 8E:
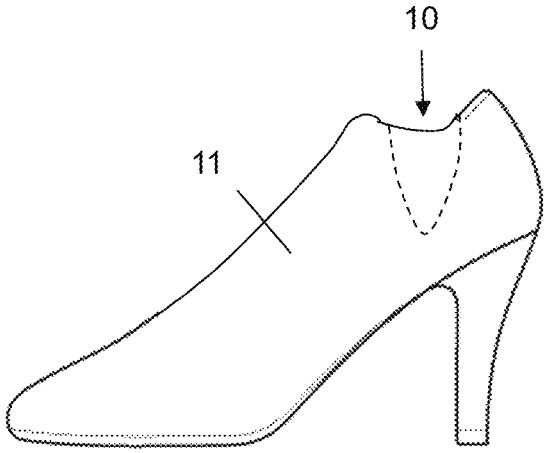

The retention elements can be uniformly distributed about the inner circumference of opening 10. The term "uniformly distributed" refers to rings or threads that are evenly spaced along the inner surface of the opening. For example, the distance between any two adjacent rings is the same as the distance between any other two adjacent rings. In other embodiments, one or more regions of the opening can include a non-uniform distribution of retention elements, such as a greater number of retention elements (e.g., areas that most often contact a doll foot), as shown in FIGS. 6*a*-6*c*. Specifically, in the shoe of FIG. 6*a*, retention elements 15 are clustered (e.g., increased in number) adjacent to the first end of the top opening of the shoe, as indicated by region 50. FIG. 6*b* illustrates a concentration of retention elements positioned between the first and second ends of opening 10, as indicated by region 51. FIG. 6*c* illustrates an embodiment showing retention elements 15 with a concentration at the second end of opening 10, as indicated by region 52. Such clustered configurations of the retention elements may be advantageous to further retain a doll foot within the interior opening (e.g., making it more difficult for the shoe to be inadvertently dislodged due to the higher concentration of retention elements that the shoe must pass or escape from).

The retention elements (e.g., helical threads 16 and/or rings 17) can be constructed from any suitable material that allows a doll foot that is inserted into the top opening to frictionally engage with and be gripped by the threads. Suitable materials can include (but are not limited to) rubber, silicone, metal, wood, plastic (PET/PETE, HDPE, PVC, LDPE, PP, PS and PES), and the like. In some embodiments, the retention elements are rigid. In other embodiments, the retention elements are flexible and can move in response to the doll foot to accommodate a snug fit. The term "rigid" refers to a material that is stiff and does not stretch easily or maintains very close to its original form after a force or pressure has been applied to it. The term "flexible" refers to a material capable of bending, stretching, compressing or twisting without breaking.

Shoe 5 also includes counterweight 20 that balances the weight of the doll when the shoe is fitted onto a doll leg. In some embodiments, the term "counterweight" refers to weight used to provide a counterbalancing effect to the doll when the shoe is worn. However, the term "counterweight" also includes an area of increased density or weight compared to the remainder of the shoe, as shown in FIG. 1*c*. Counterweight 20 can be positioned at or near front 28 of the shoe (e.g., at the end of the shoe opposite opening 10) in some embodiments. In some embodiments, the counterweight is positioned adjacent to the bottom face of the shoe, as shown in FIG. 7*a*. In some embodiments, the counterweight directly contacts front face 28 of the shoe, as shown in FIG. 7*b*. Contact between the counterweight and the front of the shoe may be beneficial to provide additional stability and prevent the doll from toppling over when wearing the shoe.

The counterweight can be retained in position within the shoe interior using any conventional mechanism, such as the use of adhesive, welding, magnets, fasteners, screws, bolts, clips, and the like. Any mechanism can be used.

As noted above, the counterweight can also be configured as an area of the shoe that has increased weight compared to another area (e.g., the area that includes the top opening) of the shoe. As shown in FIG. 7*c*, counterweight 20 can be configured as the entire toe region and the area to the left of the dotted line. For example, the counterweight region can be constructed from a material with greater density compared to the remainder of the shoe (e.g., the region to the left of the dotted line). Alternatively, the material used in the counterweight region can have a greater weight when compared to the remainder of the shoe.

Counterweight 20 can have any desired weight, such as about 1-16 ounces or more (e.g., at least/no more than about 1, 2, 3, 4, 5, 6, 7, 8, 9, 10, 11, 12, 13, 14, 15, or 16 ounces). However, the presently disclosed subject matter is not limited and the counterweight can be configured with a weight greater than the given range (e.g., more than 1 pound).

Shoe 5 can be configured in any desired form, as noted above. Thus, the shoe can be an elf shoe (as shown in FIGS. 1*a* and 1*b*) in some embodiments. However, shoe 5 is not limited and can include any type of footwear, such as athletic shoe 6, high top shoe 7, boot 8, slip on shoe 9, or even a heeled shoe 11 as shown in FIGS. 8*a*-8*e*. The term "elf shoe" refers generally to any type of shoe with a pointed and/or raised toe region. The term "athletic shoe" refers to a sneaker or other type of sporty shoe, typically of the type worn during playing sports, walking, and the like. A "high top" shoe includes an extended upper region. The term "boot" refers to sturdy footwear, typically covering the ankle, foot, and sometimes a portion of the leg. The term "heel" or "high heel" refers to a type of shoe with a raised heel region. A slip on shoe includes those without any type of fastening elements (e.g., laces, VELCRO®, and the like).

Shoe 5 can be constructed from any suitable material, such as (but not limited to) plastic, metal, wood, fabric, rubber, silicone, or combinations thereof. Any material can be used.

Figure 9A:
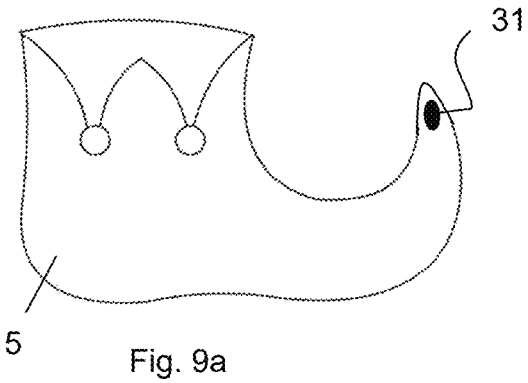
FIGS. 9*a* and 9*b* are side views of shoes in accordance with some embodiments of the presently disclosed subject matter.
Figure 9B:
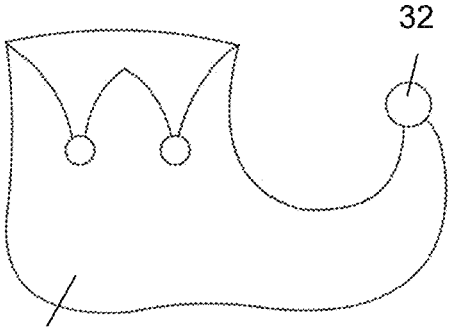

The shoe can also be configured in any desired color or pattern, and can include any type of adornment (stenciling, screen printing). For example, the shoe can include aperture 31 that allows for attachment of an adornment, such as bell 32 as shown in FIGS. 9*a* and 9*b*. However, the aperture is optional.

Figure 10A:
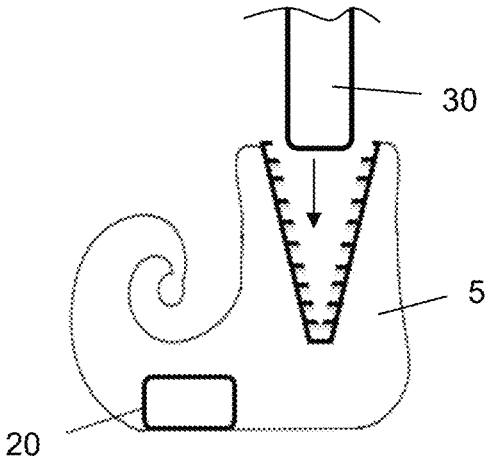
FIGS. 10*a* and 10*b* are side cross-sectional views of a doll foot inserting into the top opening of a doll shoe in accordance with some embodiments of the presently disclosed subject matter.
Figure 10B:
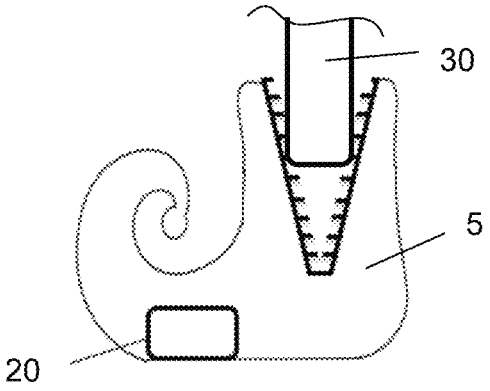
Figure 10C:
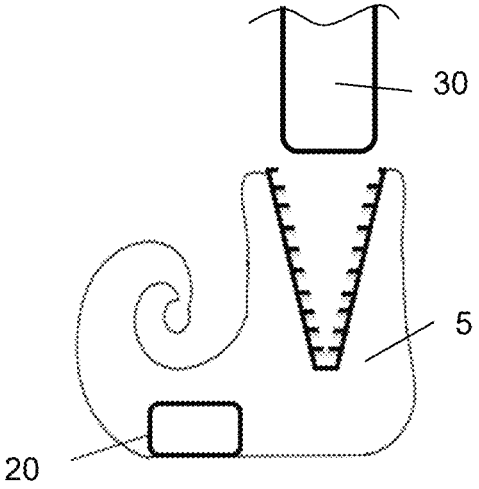
FIGS. 10*c* and 10*d* are side cross-sectional views of a doll foot inserting into the top opening of a doll shoe in accordance with some embodiments of the presently disclosed subject matter.
Figure 10D:
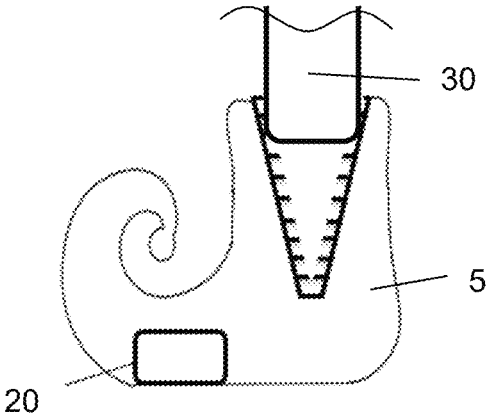

In use, shoe 5 can be reliably retained on the foot of a doll. Beneficially, retention elements 15 of shoe 5 allow a variety of doll feet/legs in different sizes and shapes to be retained within the shoe interior. Specifically, retention elements 15 can grip and hold a doll foot within the shoe top opening, regardless of the shape of the doll foot. For example, FIGS. 10*a* and 10*b* illustrate a peg doll leg that is effectively retained by the retention elements. The term "peg" refers to a cylindrical device that can optionally taper at the distal end of the doll foot. FIGS. 10*c* and 10*d* illustrate a second peg doll foot with a larger dimension compared to the leg of FIG. 10*a*, also retained within the interior of the doll shoe top opening. The doll foot/leg is gripped by the retention elements and the shoe is thereby retained on the foot. In some embodiments, the gripping action by the retention elements also function to support the doll leg/foot or the entire doll in a standing state.

Figure 11A:
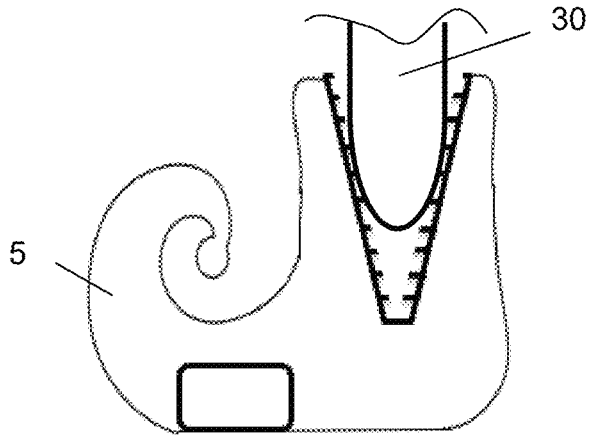
FIG. 11*a* is a side cross-sectional view of a rounded doll foot inserted into the top opening of a doll shoe in accordance with some embodiments of the presently disclosed subject matter.
Figure 11B:
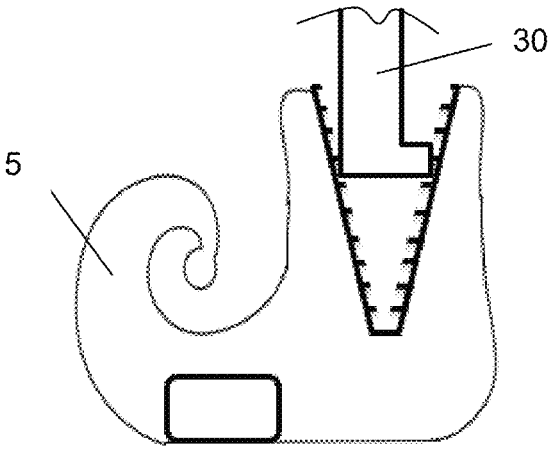
FIG. 11*b* is a side cross-sectional view of an L-shaped doll foot inserted into the top opening of a doll shoe in accordance with some embodiments of the presently disclosed subject matter.
Figure 11C:
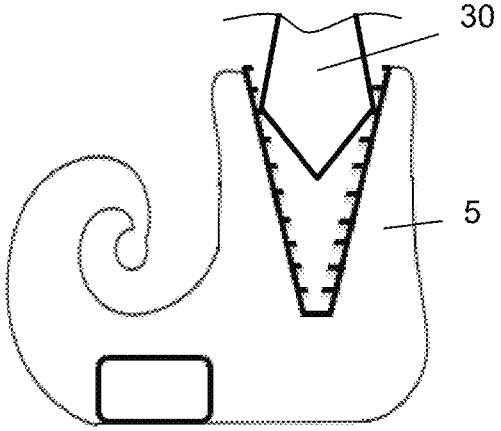
FIG. 11*c* is a side cross-sectional view of a pointed doll foot inserted into the top opening of a doll shoe in accordance with some embodiments of the presently disclosed subject matter.

The doll shoe is not limited to dolls that include peg style feet. Rather, the shoe can be used with dolls that have any shaped foot, as shown in FIGS. 11*a*-11*c*. For example, the doll foot can be rounded, L-shaped, or have a pointed end. The shape of foot 30 is not limited and any shape can be used. Shoe 5 can therefore be used with any of a wide variety of dolls that include a variety of feet. One representative (but not limiting) example is the doll described in U.S. Pat. No. 11,986,748, the entire content of which is incorporated by reference herein.

Figure 12:
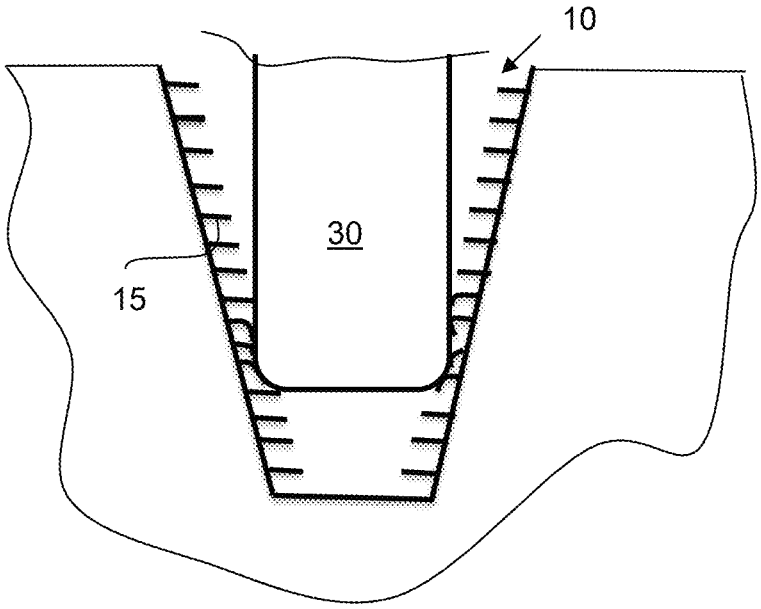
FIG. 12 is a fragmentary side cross-sectional view of a doll foot inserted into the top opening of a doll shoe in accordance with some embodiments of the presently disclosed subject matter.

Once the doll feet have been secured within the interior of shoe 5 and are retained in position due to contact with the retention elements 15, the doll can be put and kept in a standing position. The weight of the doll is offset by counterweight 20, preventing the doll from toppling over. Shoe 5 therefore provides a stable base or support for the doll where it can readily and without unusual carefulness be placed in a standing position and will maintain the standing position. In addition, due to the gripping motion of the retention elements as shown in FIG. 12, the shoe is securely retained on the doll's foot.

When a user desires to remove shoe 5 from the doll's foot, light pressure can be applied to the doll's leg or the shoe to separate the two. The shoe can then be stored until it is needed at a later time.

Shoe 5 offers many advantages over prior art doll shoes. For example, the disclosed shoe can securely and reliably grip a doll foot using retention elements 15. The shoe is less likely to be separated from the doll's foot and accidentally lost. Shoe 5 can therefore provide cost savings by preventing users from buying alternate pairs of doll shoes when one or more is lost.

Shoe 5 can be used with a variety of dolls, each having a different type of foot in a different size. The shoe is therefore universal.

The disclosed shoe (or pair of shoes to be used with a pair of doll feet) is easy to use, such that even children can use and enjoy the shoe.

Shoe 5 can be detachably connected to the doll, providing a stable supporting characteristic to the doll when in an upright or standing position.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A doll shoe comprising a top face and an opposed bottom face, a front face and an opposed rear face, and a pair of side faces;

wherein the top face comprises an opening that extends into an interior of the doll shoe, the opening defined by one or more retention elements;

wherein the shoe includes a counterweight;

wherein the opening has a first end adjacent to the top face of the doll shoe and an opposed second end within the shoe interior, and wherein the opening is tapered from the opening first end to the opening second end;

wherein the one or more retention elements are configured as concentric rings, each ring having a diameter that decreases as the rings move from the opening first end to the opening second end; and wherein the concentric rings are clustered adjacent to the first end of the opening, the second end of the opening, or between the first and second ends of the opening.

2. The doll shoe of claim 1, wherein the opening has a conical shape.

3. The doll shoe of claim 1, wherein the one or more retention elements are configured as a helical thread that tapers and extends a length of the opening.

4. The doll shoe of claim 1, wherein a diameter of the first end of the opening is about 0.2-2 inches and a diameter of the second end of the opening is about 0.1-1.9 inches.

5. The doll shoe of claim 1, wherein the diameter of a ring positioned adjacent to the first end of the opening is about 0.2-2 inches and the diameter of a ring positioned adjacent to the second end of the opening is about 0.1-1.9 inches.

6. The doll shoe of claim 1, wherein the concentric rings are uniformly distributed along the opening from the first end to the second end.

7. The doll shoe of claim 1, wherein the one or more retention elements are constructed from rubber, silicone, metal, wood, plastic, or combinations thereof.

8. The doll shoe of claim 1, wherein the one or more retention elements are stiff and do not stretch.

9. The doll shoe of claim 1, wherein the one or more retention elements are configured to bend, stretch, compress, or twist without breaking.

10. The doll shoe of claim 1, wherein the counterweight is configured as a weight positioned adjacent to the front side of the shoe.

11. The doll shoe of claim 1, wherein the counterweight is configured as a region of the shoe positioned adjacent to, but separate from, the top opening of the shoe.

12. The doll shoe of claim 1, wherein the counterweight has a weight of about 1-16 ounces.

13. A method of retaining a doll shoe on a foot of a doll, the method comprising:

inserting the doll foot within the top opening of the doll shoe of claim 1;

applying pressure such that the one or more retention elements contact and retain the doll foot within the top opening of the doll shoe;

removing the pressure, whereby the one or more retention elements grip the doll foot and thereby retain the doll foot within the top opening of the shoe.

14. The method of claim 13, wherein the doll foot is a peg foot.

15. The method of claim 13, wherein a shoe is positioned on each foot of the doll.

16. The method of claim 13, wherein the doll maintains a standing position after the shoes have been retained on the feet of the doll.

17. The method of claim 13, wherein the one or more retention elements are configured as a helical thread that tapers and extends a length of the opening or wherein the retention elements are configured as concentric rings, each ring having a diameter that decreases as the rings move from the opening first end to the opening second end.

* * * * *